United States Patent [19]

Harada et al.

[11] Patent Number: 4,726,799

[45] Date of Patent: Feb. 23, 1988

[54] OUTBOARD MOTOR

[75] Inventors: Norimichi Harada; Ryoji Nakahama; Naoyoshi Kuragaki, all of Shizuoka, Japan

[73] Assignee: Sanshin Kogyo Kabushiki Kaisha, Japan

[21] Appl. No.: 827,944

[22] Filed: Feb. 10, 1986

Related U.S. Application Data

[62] Division of Ser. No. 643,646, Aug. 23, 1984, Pat. No. 4,615,683.

[30] Foreign Application Priority Data

Aug. 24, 1983 [JP] Japan ..... 58-153014
Aug. 26, 1983 [JP] Japan ..... 58-154889

[51] Int. Cl.[4] ..... B63H 21/24
[52] U.S. Cl. ..... 440/76
[58] Field of Search ..... 440/49-63, 440/75, 76, 77, 900; 123/195 P

[56] References Cited

U.S. PATENT DOCUMENTS

| | | | |
|---|---|---|---|
| 2,091,247 | 8/1937 | Williams, Jr. | 440/89 |
| 2,676,559 | 4/1954 | Davies | 440/53 |
| 2,691,954 | 10/1954 | Shively | 440/58 |
| 3,083,678 | 4/1963 | Leipert | 440/89 |
| 4,382,797 | 5/1983 | Blanchard | 440/75 |

*Primary Examiner*—Sherman D. Basinger
*Assistant Examiner*—Jesûs D. Sotelo
*Attorney, Agent, or Firm*—Ernest A. Beutler

[57] ABSTRACT

An outboard motor arrangement and particularly an improved power head construction therefor embodying a hinged cover member that is pivotal to offer access to the engine for servicing without necessitating its removal. In addition, an elastomeric support is provided for the engine that minimizes the transmission of vibrations from the engine to the associated watercraft.

7 Claims, 3 Drawing Figures

OUTBOARD MOTOR

This is a division of application Ser. No. 643,646, filed Aug. 23, 1984, now issued as U.S. Pat. No. 4,615,683 on Oct. 7, 1986.

BACKGROUND OF THE INVENTION

This invention relates to an outboard motor and more particularly to an improved power head structure for an outboard motor.

As is well known, outboard motors include a power head in which the powering internal combustion engine is contained within an outer protective cowling. The protective cowling is provided so as to insure protection of the engine from the water in which the motor operates. However, it is desirable, if not essential, that the protective cowling be constructed in such a way so as to afford access to the engine for servicing and other reasons. One form of protective cowling employs a lower tray to which the internal combustion engine is affixed and a main, upper cover portion that is detachably connected to the tray and which has an inverted cup shape. Although such arrangements offer free access to the engine when the main cowling portion is removed, the size and bulk of the cowling makes it difficult to remove when the motor is attached to the transom of a watercraft and when attempting to service the engine in the water.

It has also been proposed to employ an outer cowling of the type wherein the cowling members are hinged together so as to afford access without necessitating complete removal of one of them. Such arrangements of the type heretofore proposed have, however, several disavantages. For example, it is difficult to insure good sealing of the various cowling members because of the material from which they are formed. Also, it has been proposed to employ an internal frame structure for supporting the cowling members and this frame structure itself retards or impedes access to the components of the engine to be serviced.

It is, therefore, an object of this invention to provide an improved power head structure for an outboard motor.

It is another object of this invention to provide a power head structure for an outboard motor wherein the cowling affords easy access to the enclosed engine and yet wherein good sealing may be accomplished and ease of opening is insured.

Since an outboard motor is attached directly to the transom of the watercraft and since it contains an internal combustion engine which generates a number of vibrations of different magnitudes and different types, it is desirable to provide some arrangement for insuring that these vibrations will not be transmitted to the occupants of the watercraft. One way in which this may be done is by mounting the engine and/or outboard motor in a resilient manner relative to the watercraft. Although a variety of devices have been proposed to achieve this result, they have not been truly effective in isolating vibrations or, alternatively, they have been so complicated as to make servicing of the engine and its mounting difficult.

It is, therefore, a further object of this invention to provide an improved arrangement for resiliently suspending the internal combustion engine of an outboard motor.

It is another object of this invention to provide an improved suspension arrangement for the internal combustion engine of an outboard motor wherein the damping arrangement is located at an optimum position with respect to the engine.

SUMMARY OF THE INVENTION

A first feature of this invention is adapted to be embodied in a power head for an outboard motor comprising an internal combustion engine having its output shaft journaled for rotation about a generally horizontally disposed axis and adapted to drive a propeller disposed beneath the output shaft axis. A protective cowling comprising a lower member encircles the output shaft and has an upwardly disposed opening for affording access to the engine. Means are provided for mounting the lower member relative to a transom of the associated watercraft for steering movement about a generally vertically extending steering axis and for tilting movement about a generally horizontally disposed tilt axis. A cover member is hingedly connected to the protective cowling lower member about a hinge axis that is disposed rearwardly of the power head from the tilt axis and which is adapted to close the lower member opening.

Another feature of the invention is adapted to be embodied in a power head engine mounting arrangement for an outboard motor that includes a reciprocating type internal combustion engine, a swivel bracket adapted to be affixed to the hull of an associated watercraft and means for elastically suspending the engine from the swivel bracket comprising a first elastic element affixed directly to the engine at a point above the axis of rotation of the engine output shaft and a pair of elastic elements fixed relative to the engine at transversely spaced locations below the output shaft axis.

Yet another feature of the invention is adapted to be also embodied in a power head engine mounting arrangement for an outboard motor comprising a reciprocating type internal combustion engine having an inertial axis extending in a generally vertical direction and a swivel bracket that is adapted to be affixed relative to the hull of an associated watercraft. In connection with this embodiment of the invention, means elastically suspend the engine from the swivel bracket comprising a first elastic element fixed relative to the engine at an upper point and a pair of lower elastic elements affixed to the engine at a lower point. The elastic elements are disposed so as to lie substantially along the inertial axis.

DETAILED DESCRIPTION OF THE PREFERRED EMBODIMENT

Figure 1:
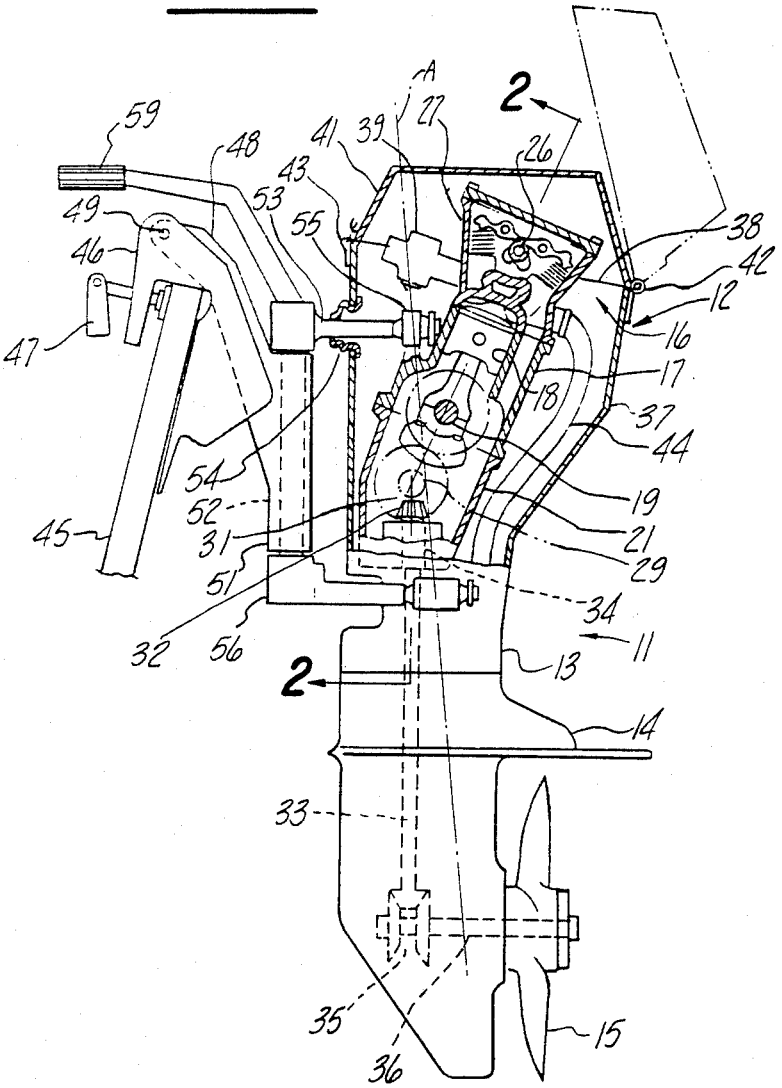
FIG. 1 is a side elevational view, with a portion broken away, of an outboard motor constructed in accordance with an embodiment of the invention.
Figure 2:
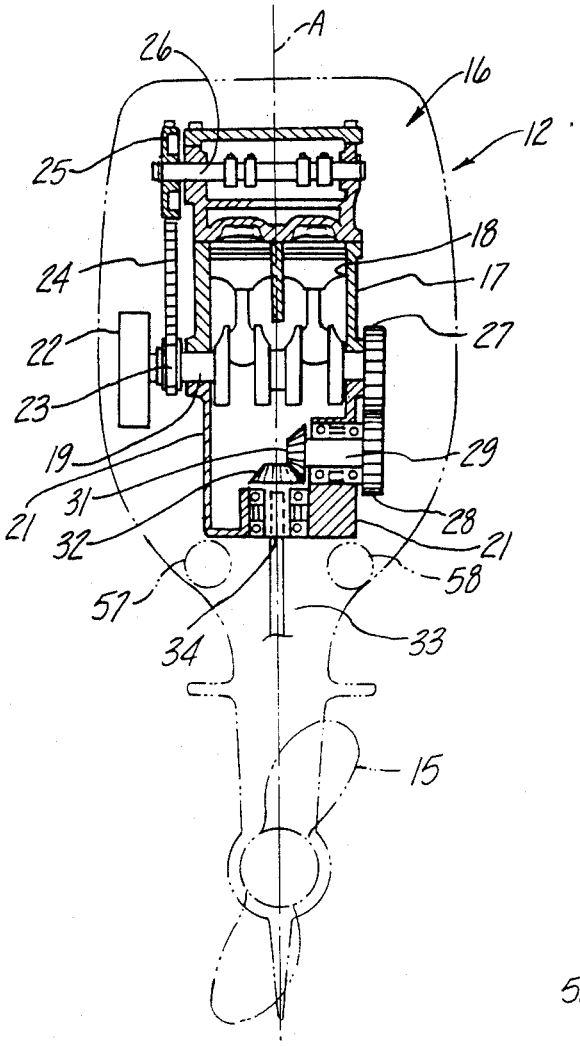
FIG. 2 is a rear plan view of the outboard motor shown in FIG. 1 with the internal combustion engine shown in cross-section about a plane taken along the line 2—2 in FIG. 1 and with the remaining portion of the outboard motor shown in phantom.
Figure 3:
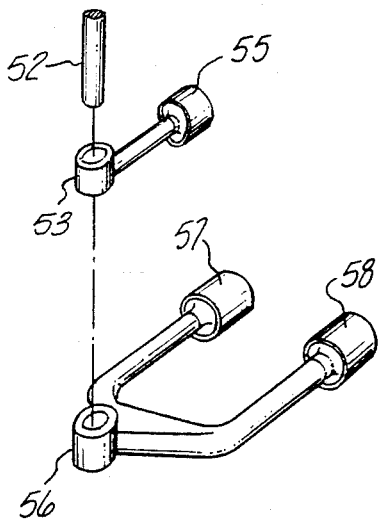
FIG. 3 is an exploded perspective view of the mounting arrangement for the internal combustion engine.

An outboard motor constructed in accordance with an embodiment of the invention is identified generally by the reference numeral 11. The outboard motor 11 includes a power head assembly, indicated generally by the reference numeral 12 and from which a drive shaft housing 13 depends. A lower unit 14 is affixed to the drive shaft housing and journals a propeller 15 for rotation.

The power head 12 includes an internal combustion engine, which is identified generally by the reference numeral 16. In accordance with the illustrated embodiment of the invention, the engine 16 is of the two cylinder in-line type and operates on a four-stroke principle. To this end, the engine 16 includes a cylinder block 17 in which a pair of cylinder bores 18 are formed. The cylinder bores 18 are disposed at a slight angle to the vertical, in the normal running position of the outboard motor 12, and are inclined rearwardly from the vertical. The cylinder bores 18 are transversely spaced from each other. Pistons are reciprocally supported in the cylinder bores 18 and are connected by means of connecting rods so as to drive a crankshaft 19 that is supported for rotation about a horizontally disposed axis that extends transversely relative to the associated watercraft. The crankshaft 19 is supported for rotation by the cylinder block 17 and a crankcase 21 that is affixed in a suitable manner to the cylinder block 17.

The crankshaft 19 extends externally of the crankcase 21 at one of its ends and has a flywheel 22 affixed to it in a known manner. Adjacent the flywheel, a driving sprocket 23 is also affixed to the crankshaft 19 for driving a timing belt 24. The timing belt 24, in turn, drives a driven pulley or sprocket 25 that is affixed to a camshaft 26 that is supported for rotation in the cylinder head 27 of the engine 12 in a suitable manner. The camshaft 26 carries a plurality of cam lobes that operate the poppet type valves of the engine 16 in a known manner.

A driving gear 27 is affixed to the opposite end of the crankshaft 19, which opposite end is also exposed externally of the crankcase 21. The driving gear 27 is in mesh with a driven gear 28 that is affixed to an intermediate shaft 29 that is journaled in the crankcase 21 and which extends internally into it. A bevel gear 31 is affixed to this inner end of the intermediate shaft 29 and is in mesh with a corresponding bevel gear 32 that is affixed to the upper end of a drive shaft 33 that is journaled in a bearing arrangement 34 formed in the lower end of the crankcase 21.

The drive shaft 33 depends through and is journaled in the drive shaft housing 13 in a suitable manner and terminates within the lower unit 14. At this point, there is positioned a forward, neutral, reverse transmission 35 of a known type which drives selectively a propeller shaft 36 to which the propeller 15 is affixed.

The power head 12 includes, in addition to the engine 16, a protective cowling comprised of a lower portion 37 which may be formed of any suitable material such as molded fiberglass or the like and which encircles the crankcase 21, cylinder block 17 and at least a portion of the cylinder head 27. The lower cowling portion 37 terminates at an upwardly facing opening 38 which surrounds the upper portion of the cylinder head 27.

The engine 12 is provided with one or more carburetors 39 which feed the combustion chambers through a suitable induction system and which are disposed at the forward portion of the opening 38. Hence, the opening 38 affords ready access to the valve train of the engine, the spark plugs and its carburetors 39. The spark plugs of the engine can be located in any appropriate area but will be mounted in the cylinder head 27 and preferably disposed adjacent to the carburetors 39.

The opening 38 is closed by a cover portion 41 that has a generally inverted cup shape and which is pivotally mounted to the lower cowling portion 37 by a hinge arrangement 42 that is disposed at the extreme rear end of the opening 38. Hence, opening of the cover portion 41 to its fully opened position, as shown in the phantom line view in FIG. 1, readily exposes the important components of the engine 16 which may require servicing. The cover 41 may be held in its closed position by means of a forwardly disposed latch mechanism 43.

The engine 16 is also provided with an exhaust system that includes one or more exhaust pipes 44 that are contained within the outer cowling and which depend downwardly through the drive shaft housing 14 for cooperation with a suitable silencing system (not shown) prior to discharge through a suitable under the water exhaust. This exhaust may take the form of one of the well known through the hub, propeller type exhaust discharges.

An arrangement is provided wherein the motor 11 may be mounted on the transom of a boat, as indicated by the reference numeral 45 in FIG. 1. This mounting arrangement includes a clamping bracket 46 that carries one or more clamps 47 so as to affix the clamping bracket 46 to the transom 45. A swivel bracket 48 is pivotally connected to the clamping bracket 46 for pivotal movement about a horizontally extending tilt axis by means of a tilt pin 49. The swivel bracket 48 has a bearing portion 51 that supports a steering shaft 52 for steering movement about a generally vertically extending axis. In accordance with a feature of the invention, the remaining portion of the outboard motor 12 is supported from the steering shaft 52 in such a manner so as to minimize the transmission of vibrations from the engine 16 to the transom 45.

The drive unit and specifically the power head 12, drive shaft housing 14 and lower unit 15 have an inertial axis which is identified by the phantom line A in the drawings and which passes through a transverse center containing the drive shaft 33 and which is inclined at a slight angle to the vertical as clearly shown in FIG. 1. In order to minimize the transmission of vibrations to the transom 45, it is desirable to insure that the elastic axis of mounting of the arrangement passes through or close to the inertial axis A. For this purpose, a first upper supporting member 53 is affixed to the upper end of the steering shaft 52 and extends rearwardly through the protective cowling member 37 and is surrounded by a sealing flexible boot 54. The rear end of the mounting member 73 carries an elastomeric arrangement 55 that is comprised of an inner member, a surrounding elastomeric sleeve and an outer sleeve that is affixed to the forward end of the cylinder block 17 directly and along the inertial axis A. It should be noted that this point of attachment is slightly above the center of rotation of the crankshaft 19 and that the center of gravity is located in the area of the crankcase closely adjacent the axis of rotation of the crankshaft 19 and on the inertial axis A.

The mounting arrangement further includes a lower bifurcated member 56 that is affixed to the lower end of the steering shaft 52 and which carries at its rearward end two elastomeric elements 57 and 58 that are substantially the same in construction as the element 55. That is, these elements include an elastomeric sleeve that encircles the rearward ends of the arms of the member 56 and a metallic outer sleeve that is affixed in a suitable manner to a rigid component of the drive shaft housing 13 at a point below the center of gravity and also at a point that lies on a plane containing the inertial axis A. In this way, it will be insured that the point of elastic support for the power plant will lie on the inertial axis A and will therefore minimize the transmission of vibrations to the hull and specifically to the transom 45.

The outboard motor 11 may be conveniently steered about the steering axis 52 by means of a tiller 59 that is affixed to the steering shaft 52 and which may be formed integrally with the supporting member 53.

It should be readily apparent from the aforenoted description that the construction is such that a relatively low center of gravity is provided for the power head 12 while the cowling arrangement offers ready access to the engine 16 for servicing. In addition, the mounting arrangement insures good vibration damping and minimizes the transmission of vibrations to the passengers in the associated watercraft.

Although an embodiment of the invention has been illustrated and described, various changes and modifications may be made without departing from the spirit and scope of the invention, as defined by the appended claims.

We claim:

1. An outboard motor comprising a power head comprised of an internal combustion engine having a generally upwardly extending cylinder with operating components thereof which require servicing at its upper end and its output shaft journaled for rotation about a generally horizontally disposed axis, means for driving a drive shaft disposed beneath said output shaft axis from said output shaft, and a protective cowling comprising a lower member encircling said output shaft and having an upwardly disposed opening for affording access to said engine and said operating components, a drive shaft housing affixed against rotation to and depending from said lower member, said drive shaft being journaled within said drive shaft housing, and a lower unit depending beneath and rigidly affixed to said drive shaft housing, said lower unit carrying propulsion means driven by said drive shaft, means for mounting said power head, said drive shaft housing and said lower unit as a complete assembly relative to a transom of an associated watercraft for steering movement about a generally vertically extending axis and for tilting movement about a generally horizontally extending axis, said protective cowling further including a cover member hingedly connected to said protective cowling lower member about a hinge axis disposed rearwardly of said power head from said tilting axis and extending parallel to said tilting axis when said power head is in a straight ahead steered condition and adapted to close said lower member opening.

2. A power head for an outboard motor as set forth in claim 1 wherein the means for driving the drive shaft comprises a countershaft rotatable about an axis parallel to the axis of the rotation of the engine output shaft and driven therefrom and bevel gear means for driving said drive shaft from said countershaft.

3. A power head for an outboard motor as set forth in claim 1 wherein the engine operates on the four-stroke cycle and has a cylinder block and crankcase rotatably supporting the engine output shaft and a cylinder head affixed to the cylinder block, there being valve operating means disposed within said cylinder head for operating valves for the engine, the lower housing opening being in juxtaposed relationship to said cylinder head and said valve operating means for servicing thereof upon opening of said cover member.

4. A power head for an outboard motor as set forth in claim 1 wherein the engine is of the in-line type with cylinders inclined rearwardly to the vertical.

5. A power head for an outboard motor as set forth in claim 4 wherein the means for driving the drive shaft comprises a countershaft rotatable about an axis parallel to the axis of the rotation of the engine output shaft and driven therefrom and bevel gear means for driving a vertically extending drive shaft from said countershaft.

6. A power head for an outboard motor as set forth in claim 5 wherein the engine operates on the four-stroke cycle and has a cylinder block and crankcase rotatably supporting the engine output shaft and a cylinder head affixed to the cylinder block, there being valve operating means disposed within said cylinder head for operating valves for the engine, the lower housing opening being in juxtaposed relationship to said cylinder head and said valve operating means for servicing thereof upon opening of said cover member.

7. A power head for an outboard motor as set forth in claim 1 wherein the means for mounting the power head, drive shaft housing and lower unit as a complete assembly relative to the transom comprises a first elastomeric member affixed directly to the engine above the axis of rotation of its output shaft and a pair of lower elastomeric members operatively connected to the engine at transversely spaced points and below the axis of rotation of its output shaft.

* * * * *